US009257798B2

(12) United States Patent
Wang

(10) Patent No.: US 9,257,798 B2
(45) Date of Patent: Feb. 9, 2016

(54) SOCKET HAVING OVERHEATING DESTRUCTIVE LIMITING ELEMENT

(71) Applicant: Chuan-Sheng Wang, Tainan (TW)

(72) Inventor: Chuan-Sheng Wang, Tainan (TW)

( * ) Notice: Subject to any disclaimer, the term of this patent is extended or adjusted under 35 U.S.C. 154(b) by 0 days.

(21) Appl. No.: 14/475,247

(22) Filed: Sep. 2, 2014

(65) Prior Publication Data

US 2015/0064959 A1 Mar. 5, 2015

(30) Foreign Application Priority Data

Sep. 3, 2013 (TW) ..... 102131742 A

(51) Int. Cl.
*H01T 1/14* (2006.01)
*H01T 4/06* (2006.01)
*H01R 13/68* (2011.01)

(52) U.S. Cl.
CPC ..... *H01R 13/68* (2013.01)

(58) Field of Classification Search
CPC ..... H01T 1/14; H01T 4/06; H01H 37/765; H01H 37/002; G08B 17/06
See application file for complete search history.

(56) References Cited

U.S. PATENT DOCUMENTS 4,056,840 A * 11/1977 Lundsgaard ..... H01T 1/14 361/119
4,233,641 A * 11/1980 Baumbach ..... H01C 7/126 361/119
4,851,957 A * 7/1989 Chung ..... H01T 1/14 361/118
5,694,285 A * 12/1997 Lee ..... H01T 1/14 340/650
5,859,579 A * 1/1999 Branston ..... H01H 71/14 337/116
5,949,322 A * 9/1999 Radbruch ..... H01H 37/5427 337/14
6,204,747 B1 * 3/2001 Kitchens ..... H01H 37/761 337/407
2011/0193674 A1 * 8/2011 Zauner ..... H01C 7/126 337/142

FOREIGN PATENT DOCUMENTS

TW 200816253 A 4/2008

* cited by examiner

*Primary Examiner* — Gary Paumen
(74) *Attorney, Agent, or Firm* — Muncy, Geissler, Olds & Lowe, P.C.

(57) ABSTRACT

A socket having an overheating destructive limiting element includes a housing, a live wire conductive plate, a neutral wire conductive plate, at least one live wire terminal, at least one neutral wire terminal, and at least one limiting element. The live wire terminal includes a live wire contact portion in contact with the live wire conductive plate. The neutral wire terminal includes a neutral wire contact portion in contact with the neutral wire conductive plate. The limiting element is an insulating body, and is placed at contact parts of the live wire conductive plate and the live wire contact portion, and/or at contact parts of the neutral wire conductive plate and the neutral wire contact portion. When an operating temperature becomes excessively high, the limiting element becomes deformed and destructed to form a turn-off position.

15 Claims, 15 Drawing Sheets

SOCKET HAVING OVERHEATING DESTRUCTIVE LIMITING ELEMENT

BACKGROUND OF THE INVENTION a) Field of the Invention

The invention relates in general to a socket having an overheating destructive limiting element, and more particularly, to a socket having a limiting element made of an insulation material that positions a live wire terminal, a live wire conductive plate and/or a neutral wire terminal and a neutral conductive plate at a turn-on position. When an operating temperature gets too high, the limiting element becomes deformed and destructed to change the live wire terminal, the live wire conductive plate and/or the neutral wire terminal and the neutral conductive plate to a turn-off position.

b) Description of the Prior Art

To prevent a circuit from issues of current overload, short circuit and overheating, a fuse or an overload protector is usually provided at the circuit. When the temperature of the circuit gets too high or the current gets too large, the fuse affected by the high temperature becomes blown or a bi-metal shrapnel of the overload protector becomes disengaged, so as to cause the circuit become open circuit and turned off to ensure electricity safety.

Regarding the prior art of a fuse structure, for example, the Taiwan Patent No. 1371053 discloses "Temperature Fuse Connection Structure", which mainly includes two terminals and a meltable metal. The two terminals are fixed and assembled at circuit wires, with two free ends of the two terminals respectively disposed with through openings. When not receiving an external force, the two free ends of the two terminals are kept at a distance in between. At least one of the two terminals is made of a flexible conductive material and is thus a flexible terminal. With the flexibility of the flexible element, an elastic force that separates the two free ends of the two terminals is formed. The meltable metal is penetrated through the openings of the two free ends. Two ends of the meltable metal are impinged by a riveting means to enlarge the two ends of the meltable metal. Further, the free ends of the two separated terminals are electrically connected, such that the free ends of the two terminals inwardly and closely come into contact while also being respectively separated outwards by the elastic force. In the event of current overload, circuit overheating or an excessively high ambient temperature, the meltable metal is heated to cause a rise in the temperature and becomes molten and broken. As such, the free ends of the two terminals become disconnected and the circuit then becomes a turn-off state.

However, due to reasons below, the above disclosure or the overload protector needs to be further improved.

First of all, in the "Temperature Fuse Connection Structure" disclosed by the Taiwan Patent No. 1371053, the meltable metal is a conductive material, and is shaped in a rivet form to electrically connect the free ends of two separate terminals. When the meltable metal is molten, it is possible that the molten and broken meltable metal be expelled from an original position by the elastic force of the two terminals, or remain stuck to the two terminals. If the molten meltable metal is expelled from the original position, with collisions against other objects or subsequent external forces, it is much likely that the molten meltable metal be moved back to between the two terminals or other positions that may connect the two terminals. As a result, the two terminals intended to be disconnected may again erroneously come in contact to form close circuit. If a part of the molten meltable metal remains stuck to the two terminals, the stuck molten meltable metal may also result in an erroneous contact between the two terminals to fail in a complete disconnection. Further, the expelled molten meltable metal also has a chance of coming into contact with other surrounding electronic elements to cause a short circuit. Therefore, such conventional solution is exposed to potential hazards and needs to be improved.

Secondly, in the "Temperature Fuse Connection Structure" disclosed by the Taiwan Patent No. 1371053, the meltable metal fixes the two terminals by a riveting means, which requires the two terminals to be provided with corresponding through openings. The presence of the two openings equivalently reduces the mutual contact area between the two terminals. When the current passes through the contact part of the two terminals, a higher operating temperature is caused because of the smaller contact area. More particularly, when the two terminals are selected from a thinner material with a preferred flexibility, e.g., when the two terminals are conductive copper plates having a thickness of 0.2 mm to 0.4 mm, the rise in temperature is very noticeable.

Thirdly, a conventional overload protector has a large volume. To apply the overload protector to a socket to obtain an auto power-off effect in the event of overheating, the socket also needs a larger volume. Especially for an extension socket, e.g., an extension socket having six socket units, if each of the socket units is provided with one overload protector, the volume of the extension socket will become huge as six socket units and six overload protectors are at the same time accommodated therein. Whether for storage, transportation or usage, such excessive volume inevitably causes complications and inconveniences.

SUMMARY OF THE INVENTION

To overcome drawbacks of a power-off structure of a conventional socket and to enhance application safety of circuits, a socket having an overheating destructive limiting element is provided by the present invention.

According to an embodiment of the present invention, a socket having an overheating destructive limiting element includes: a housing, including at least one live wire hole and at least one neutral wire hole; a live wire conductive plate; a neutral wire conductive plate; at least one live wire terminal, including a live wire insertion portion and a live wire contact portion, the live wire insertion portion corresponding to the live wire hole and disposed in the housing to be in contact with the live wire conductive plate; at least one neutral wire terminal, including a neutral wire insertion portion and a neutral wire contact portion, the neutral wire insertion portion corresponding to the neutral wire hole and disposed the housing to be in contact with the neutral wire conductive plate; and at least one limiting element, being an insulating body, disposed at contact parts of the live wire conductive plate and the live wire contact portion, and/or at contact parts of the neutral wire conductive plate and the neutral wire contact portion. The limiting element becomes deformed and destructed under a thermal deformation temperature, such that the live wire contact portion disengages from the live wire conductive plate via a predetermined elastic force, and/or the neutral wire contact portion disengages from the neutral wire conductive plate via the predetermined elastic force.

Further, the limiting element includes a first insulation portion, a second insulation portion and a connection portion. The connection portion connects the first insulation portion and the second insulation portion. The connection portion, the first insulation portion and the second insulation portion define a limiting space and a placement entrance in communication with the limiting space.

Further, the first insulation portion and/or the second insulation portion of the limiting element are/is provided with a guide portion at the placement entrance. The guide portion is a slanted surface or an arched surface.

Further, between the first insulation portion and the second insulation portion of the limiting element is a distance, which gradually reduces from the connection portion towards the placement entrance.

Further, the contact parts of the live wire conducting plate and the live wire contact portion are provided with respective live wire fastening portions positioned with each other, and/or the contact parts of the neutral wire conducting plate and the neutral wire contact portion are provided with respective neutral wire fastening portions positioned with each other.

Further, the limiting element is provided with a joining portion, and a securing element having at least one securing opening. The securing opening is accommodated around the first insulation portion or the second insulation portion of the limiting element and abuts against the joining portion.

Further, the second insulation portion is located on the securing element.

Further, the second insulation portion at the securing element is a protruding surface, which closely packs the contact parts of the live wire conducting plate and the live wire contact portion, or the contact parts of the neutral wire conductive plate and the neutral wire contact portion.

Further, the limiting element includes two mutually combined cover bodies, which define respective chambers and respective opening in communication with the respective chambers.

Further, the first insulation portion includes a first fastening portion, and the second insulation portion includes a second fastening portion opposite the first fastening portion. The first fastening portion is an embedding pole, and the second fastening portion is an embedding opening. The embedding pole is for embedding into the embedding opening, and has a diameter smaller than that of the embedding opening.

Further, the limiting element is a ring body that accommodates around the contact parts of the live wire conductive plate and the live wire contact portion, and/or the contact parts of the neutral wire conductive plate and the neutral wire contact portion. The first insulation portion and the second insulation portion are both located at an inner side of the ring body.

Further, the limiting element is a plastic material selected from a group consisting of: polyamide (PA) fibers, polypropylene (PP), acrylonitrile butadiene styrene copolymer (ABS resin), polymethyl methacrylate (PMMA), polycarbonate (PC), and a mixture of PC and styrene copolymer ABS resin. The thermal deformation temperature is between 100° C. and 300° C.

The prevent invention further includes an elastic member, which is connected at the housing and the live wire contact portion, and/or at the housing and the neutral wire contact portion.

The present invention offers following effects.

1. The limiting element of the present invention is an insulation material. When an operating temperature of the socket gets too high, the limiting element becomes deformed and destructed to change the socket to a turn-off state. Further, the insulating property of the limiting element prevents the destructed limiting element from coming into unintended contact with surrounding electronic elements to ensure safety after disconnecting the power.

2. In the socket having an overheating destructive limiting element of the present invention, without involving rivet openings as used in a convention solution, the live wire terminal, the live wire conductive plate, and/or the neutral wire terminal and the neutral wire conductive plate are secured at a turn-on position. Not only a processing procedure is simplified, but also sufficient contact areas are provided between the live wire terminal, the live wire conductive plate, and/or the neutral wire terminal and the neutral wire conductive plate to mitigate the rise in temperature when the current passes through.

3. In the socket having an overheating destructive limiting element of the present invention, respective fastening portions for fastening with one another are provided at the live wire terminal, the live wire conductive plate, and/or the neutral wire terminal and the neutral wire conductive plate. Further, the first positioning portion and the second positioning portion that position with each other are provided at the limiting element. As such, it is ensured that the live wire terminal, the live wire conductive plate, the neutral wire terminal and the neutral wire conductive plate are positioned and prevented from dislocation. Therefore, during an installation process, the live wire terminal and the neutral wire terminal are allowed to precisely align with the live wire hole and the neutral wire hole at the housing to effectively maintain a product yield rate.

4. The socket having an overheating destructive limiting element of the present invention, for whether a single socket or an extension socket, is capable of appropriate disconnecting the power to ensure electricity safety when a load of the socket gets too high, including situations of poor contacts as a result of a plug not entirely plugged into the socket, and an end of the load being a high power consuming electronic product continuously used for a long period of time.

5. For an extension socket, multiple sets of live wire terminals "individually" come into contact with a live wire conductive plate, and multiple sets of neutral wire terminals also "individually" come into contact with a neutral wire conductive plate. When any set of the live wire terminals disengages from the live wire conductive plate to become open circuit or any set of the neutral wire terminals disengages from the neutral wire conductive plate to become open circuit, a power-on state of other live wire terminals with the live wire conductive plate and a power-on state of other neutral wire terminals with the neutral wire conductive plate are kept unaffected. That is, for an extension socket, when any of multiple sets of socket units becomes turned off due to overheating, other non-overheated socket units are maintained powered on and are capable of continuing supplying power. More particularly, as the limiting element has a small volume, an extension socket allows every socket to be individually powered off by requiring almost no additional volume.

The above and other aspects of the invention will become better understood with regard to the following detailed description of the preferred but non-limiting embodiments. The following description is made with reference to the accompanying drawings.

DETAILED DESCRIPTION OF THE PREFERRED EMBODIMENTS

The above and other aspects of the invention will become better understood with regard to the following detailed description of the preferred but non-limiting embodiments. The following description is made with reference to the accompanying drawings.

Figure 1:
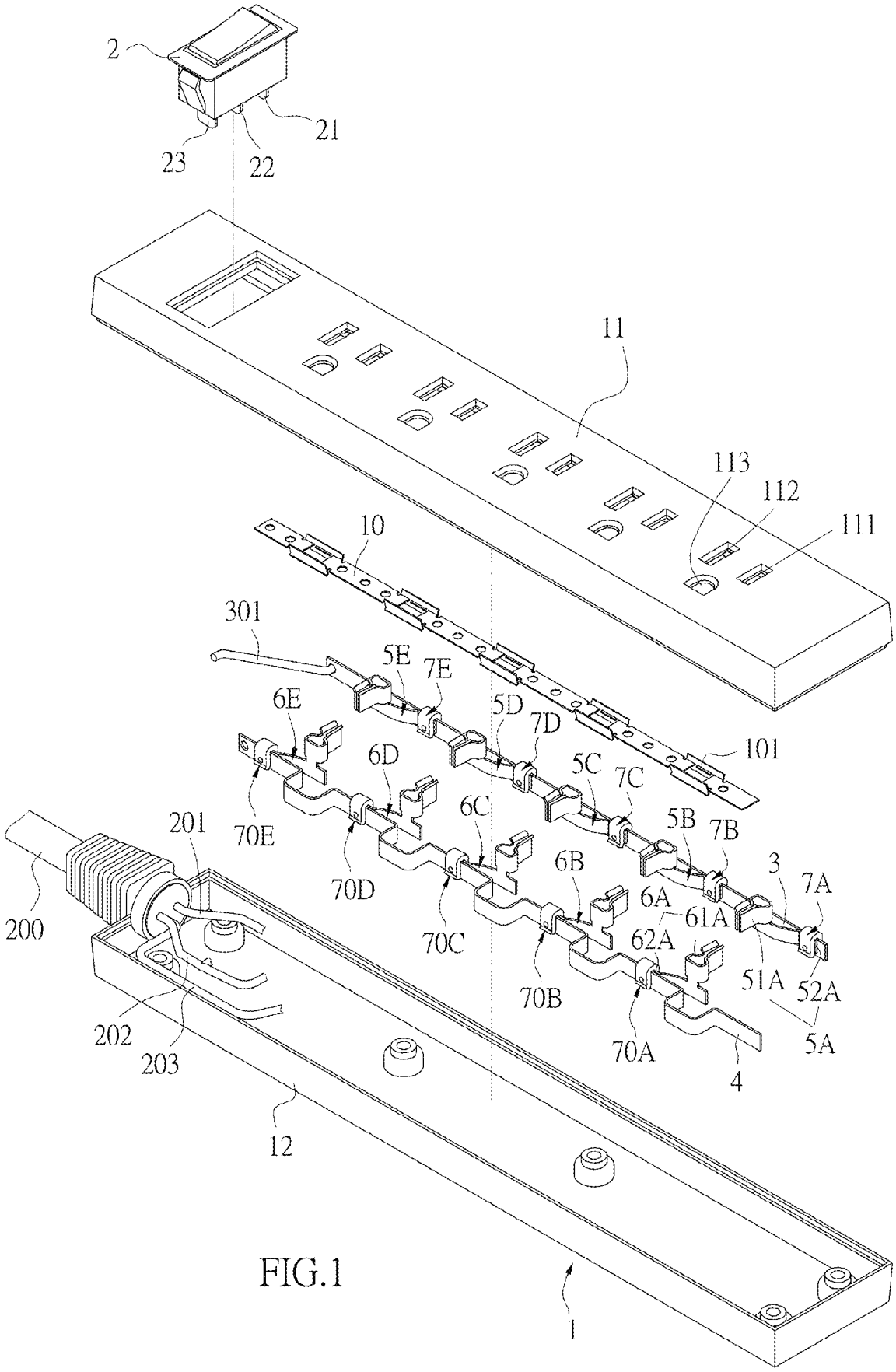
FIG. 1 is an exploded view of a socket having an overheating destructive limiting element according to a first embodiment of the present invention.
Figure 2:
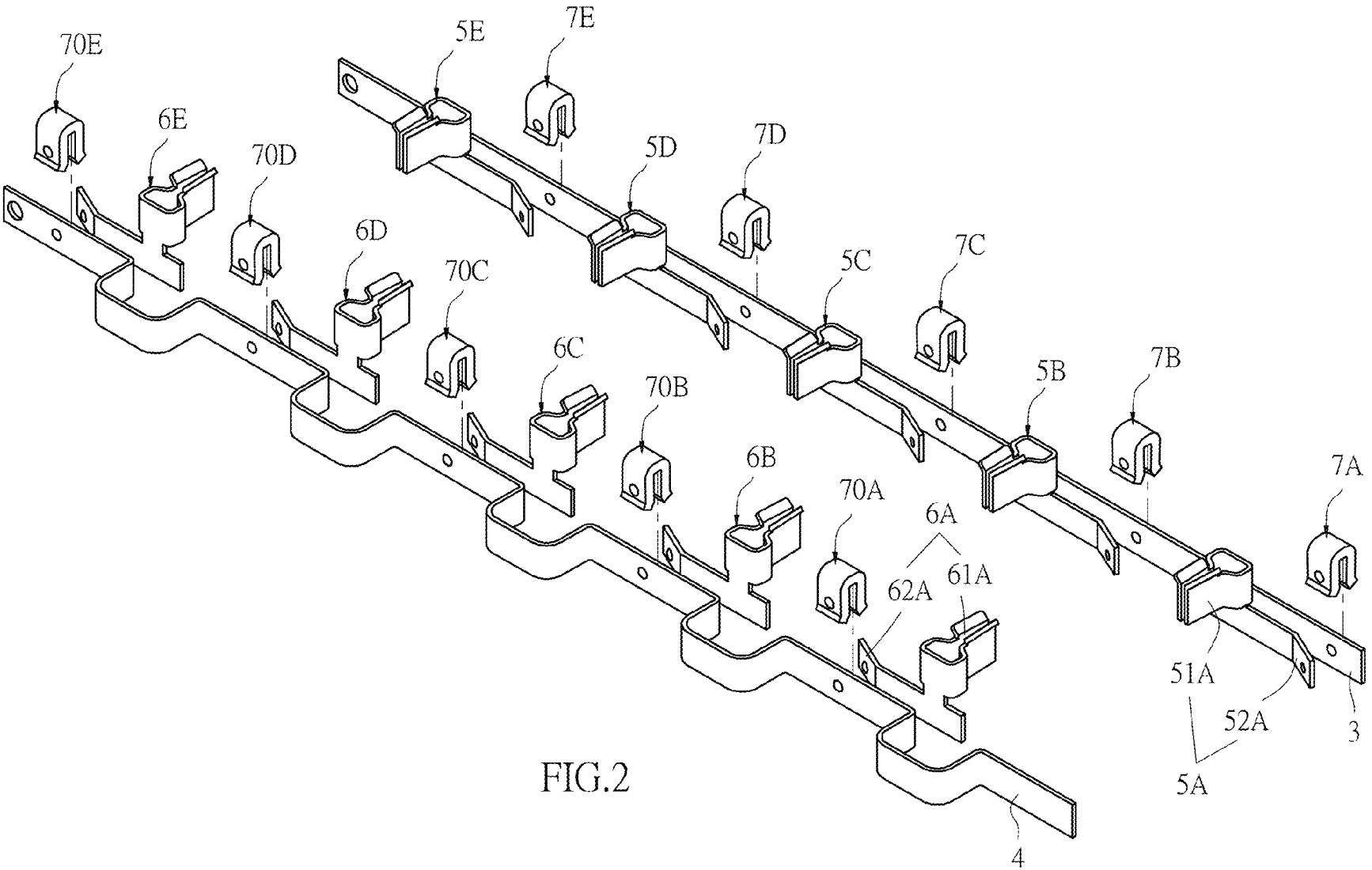
FIG. 2 is an exploded view of a socket having an overheating destructive limiting element in a turn-off position according to the first embodiment of the present invention.

Referring to FIG. 1 and FIG. 2, a socket having an overheating destructive limiting element according to a first embodiment of the present invention includes a housing 1, a switch 2, a live wire conductive plate 3, a neutral wire conductive plate 4, a plurality of live wire terminals 5A, 5B, 5C, 5D and 5E, a plurality of neutral wire terminals 6A, 6B, 6C, 6D and 6E, and a plurality of limiting elements 7A, 7B, 7C, 7D, 7E, 70A, 70B, 70C, 70D and 70E.

The housing 1 includes an upper casing 11 and a lower casing 12 that may be assembled to each other. The upper casing 11 includes a plurality of live wire holes 111 and a plurality of neutral wire holes 112.

The switch 2 includes a live wire input end 21, a live wire output end 22, and a neutral wire end 23. The live wire input end 21 is for connecting to a live wire conductive wire 201 of a power line 200. The neutral wire end 23 is for connecting to a neutral wire conductive wire 202 of the power line 200.

The live wire conductive plate 3 and the neutral wire conductive plate 4 are placed into the housing 1. The live wire conductive plate 3 is electrically connected to the live wire output end 22 of the switch 2 via a conductive line 301. The neutral wire conductive plate 4 is electrically connected to the neutral wire conductive wire 202 of the switch 2. When the switch 2 is switched on, the live wire conductive wire 201 of the power line 200 and the live wire conductive plate 3 jointly form a conducted live wire. When the switch 2 is switched off, the current is disconnected at the switch 2 such that the current cannot be transmitted to the live wire conductive plate 3.

In addition to the above elements, a ground wire copper plate 10 is further included in the embodiment. The ground wire copper plate 10 is extended as an integral to form a plurality of ground wire terminals 101. Positions of the ground wire terminals 101 correspond to a plurality of ground wire holes 113 predetermined at the upper casing 11. Meanwhile, the ground wire copper plate 10 is electrically connected to a ground wire conductive wire 203 of the power line 200. Details of the ground wire copper plate 10 and the ground wire terminal 101 are generally known art, and shall be omitted herein. Further, in the lower casing 12 in FIG. 1, certain partition plates for separating and securing the live wire conductive plate 3, the neutral wire conductive plate 4 and the ground wire copper plate 10 are also generally known art instead of technical features of the present invention, and shall not be further discussed herein and are omitted in FIG. 1 as well.

The live wire terminals 5A, 5B, 5C, 5D and 5E are similarly structured, and the live wire terminal 5A is taken as a representative example for illustrations. The live wire terminal 5A includes a live wire insertion portion 51A and a live wire contact portion 52A. The live wire insertion portion 51A is disposed in the housing 1, and corresponds to the live wire hole 111 of the housing 1.

The neutral wire terminals 6A, 6B, 6C, 6D and 6E are similarly structured, and the neutral wire terminal 6A is taken as a representative example for illustrations. The neutral wire terminal 6A includes a neutral wire insertion portion 61A and a neutral wire contact portion 62A. The neutral wire insertion portion 61A is disposed in the housing 1, and corresponds to the neutral wire hole 112. The neutral wire contact portion 62A is in contact with the neutral wire conductive plate 4. In the embodiment, the live wire contact portion 52A of the live wire terminal 5A and the live wire conductive plate 3 have a predetermined turn-off position at which they are relatively separated from each other (as shown in FIG. 2). Similarly, the neutral wire contact portion 62A of the neutral wire terminal 6A and the neutral wire conductive plate 4 have a predetermined turn-off position at which they are relatively separated from each other (as shown in FIG. 2).

The limiting elements 7A, 7B, 7C, 7D, 7E, 70A, 70B, 70C, 70D and 70E are respectively insulating bodies that become deformed and destructed under a thermal deformation temperature. More specifically, the limiting elements 7A, 7B, 7C, 7D, 7E, 70A, 70B, 70C, 70D and 70E are made of a plastic material, which is selected from a group consisting of polyamide (PA) fibers, polypropylene (PP), acrylonitrile butadiene styrene copolymer (ABS resin), polymethyl methacrylate (PMMA), polycarbonate (PC), and a mixture of PC and styrene copolymer ABS resin. The thermal deformation temperature is between 100° C. and 300° C.

One group of the limiting elements 7A, 7B, 7C, 7D and 7E are placed between the live wire conductive plate 3 and the respective live wire terminals 5A, 5B, 5C, 5D and 5E, such that the live wire conductive plate 3 comes into contact with the live wire contact portions (only the live wire contact portion 52A of the live wire terminal 5A is depicted for the sake of simplicity) of the live wire terminals 5A, 5B, 5C, 5D and 5E to form a turn-on position and to cause the live wire contact portion 52A to have a predetermined elastic force. The other group of the limiting elements 70A, 70B, 70C, 70D and 70E are placed between the neutral wire conductive plate 4 and the respective neutral wire terminals 6A, 6B, 6C, 6D and 6E, such that the neutral wire conductive plate 4 comes into contact with the neutral contact portions (only the neutral wire contact portion 62A of the neutral wire terminal 6A is depicted for the sake of simplicity) of the neutral wire terminals 6A, 6B, 6C, 6D and 6E to similarly form a turn-on position and to cause the neutral wire contact portion 62A have a predetermined elastic force.

Figure 3:
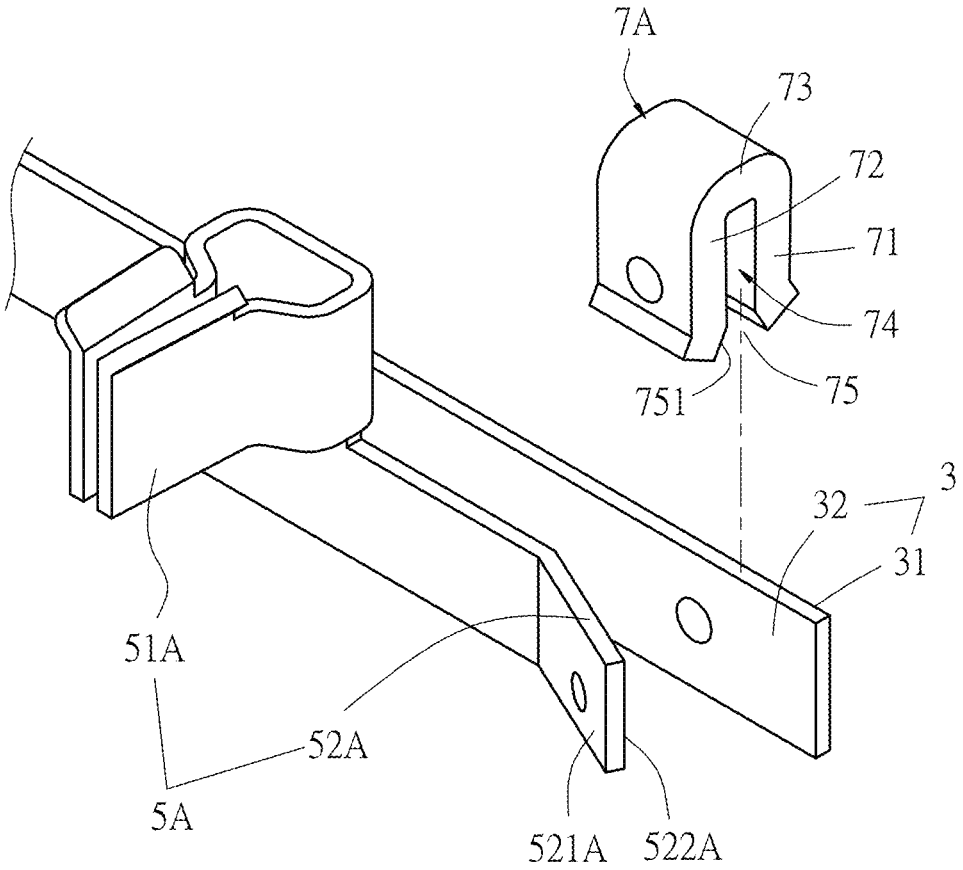
FIG. 3 is a partial exploded view of a socket having an overheating destructive limiting element according to the first embodiment of the present invention.
Figure 4:
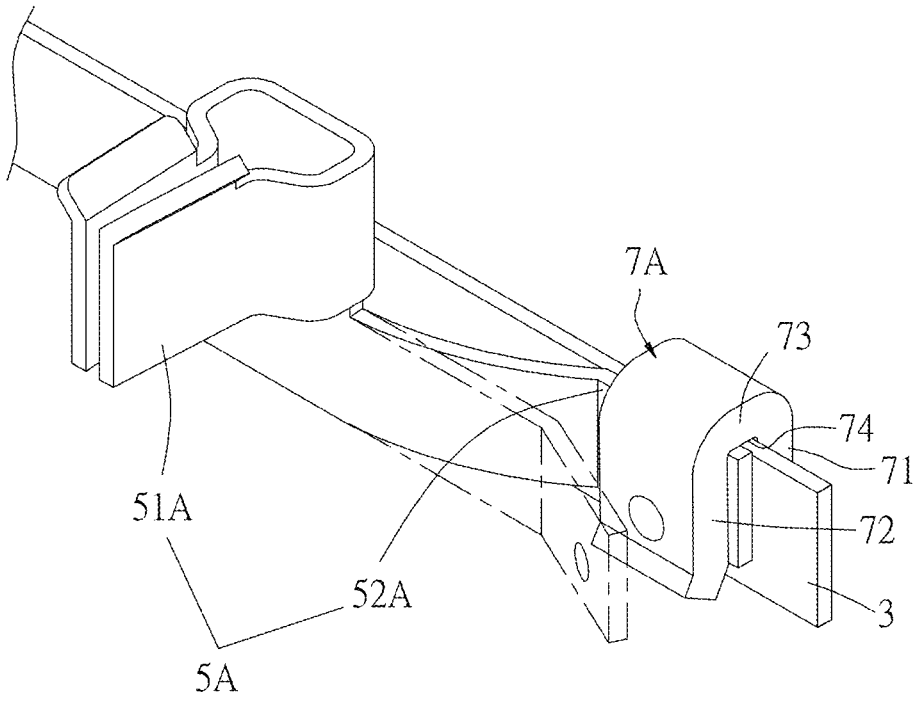
FIG. 4 is an enlarged partial view of a socket having an overheating destructive limiting element in FIG. 1 according to the first embodiment of the present invention.

FIG. 3 and FIG. 4 show partial exploded views of the present invention for further describing details of the present invention. The live wire conductive plate 3 and the live wire contact portion 52A include first sides 31 and 521A, respectively, and second sides 32 and 522A opposite the first sides 31 and 521A, respectively. The second sides 32 and 522A of the live wire conductive plate 3 and the live wire contact portion 52A face each other, and may come into contact with each other to form a turn-on state or separate from each other to form a turn-off state.

Figure 7:
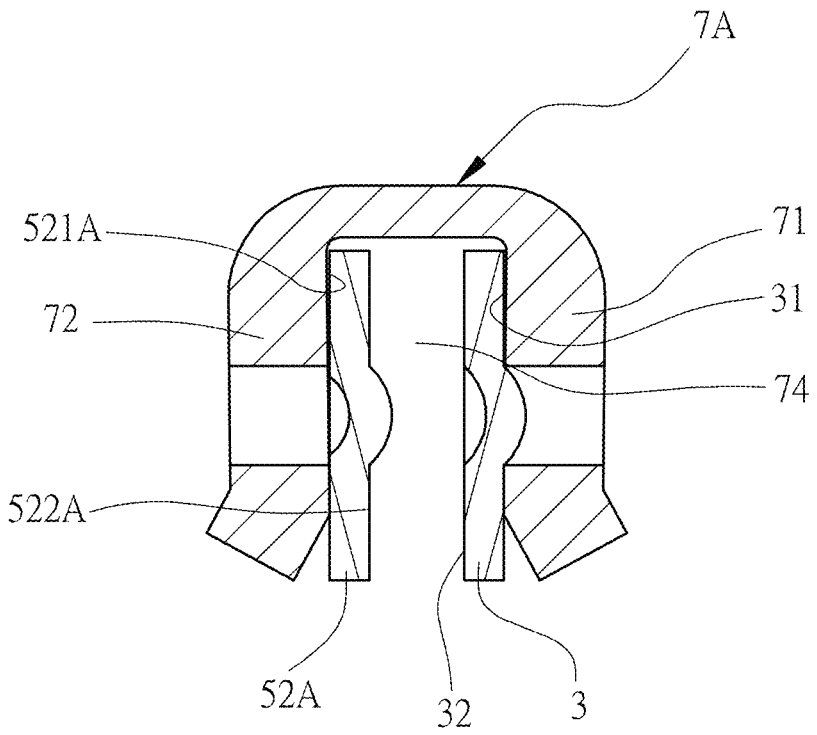
FIG. 7 is a section view of a socket having an overheating destructive limiting element when deformed and destructed according to the first embodiment of the present invention.

The limiting element 7A includes a first insulation portion 71 and a second insulation portion 72 opposite the first insulation portion 71. The first insulation portion 71 and the second insulation portion 72 are pressed against the first sides 31 and 521A of the live wire conductive plate 3 and the live wire contact portion 52A, respectively, to overpower a restoring force that separates the live wire conductive plate 3 and the live wire contact portion 52A. As such, the second sides 32 and 522A of the live wire conductive plate 3 and the live wire contact portion 52A come into contact with each other to form a turn-on state. Alternatively, when the operating temperature reaches the thermal deformation temperature (e.g., 120° C.), the limiting element 7A becomes deformed and destructed under the influence of the thermal deformation temperature. Consequently, the live wire conductive plate 3 and the live wire contact portion 52A become separated from each other to form the turn-off state (referring to FIG. 7), and the current supply is disconnected to prevent the operating temperature from rising further.

Figure 5:
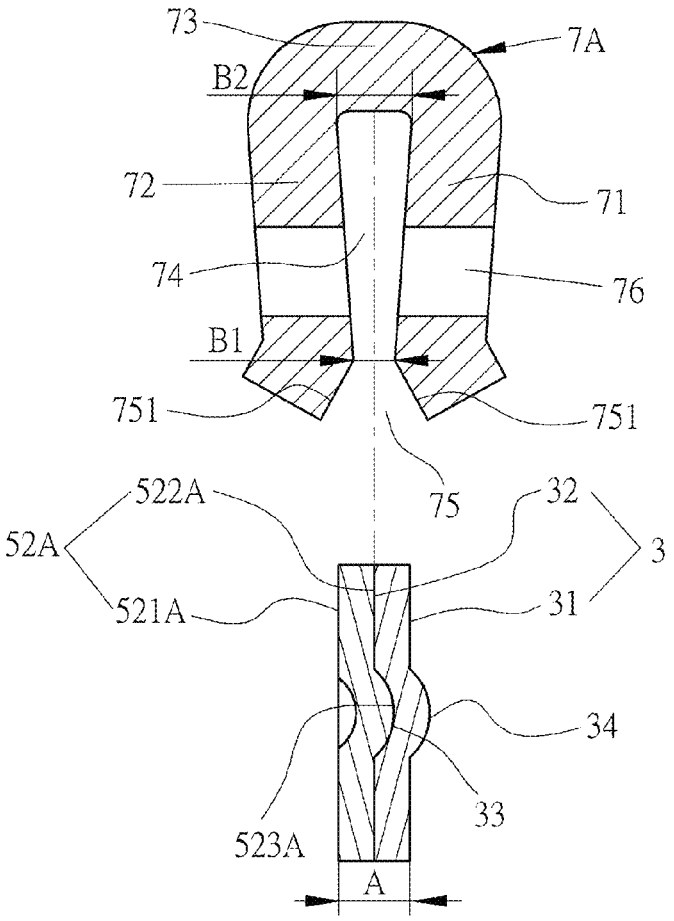
FIG. 5 is an exploded section view of a socket having an overheating destructive limiting element in FIG. 4 according to the first embodiment of the present invention.
Figure 6:
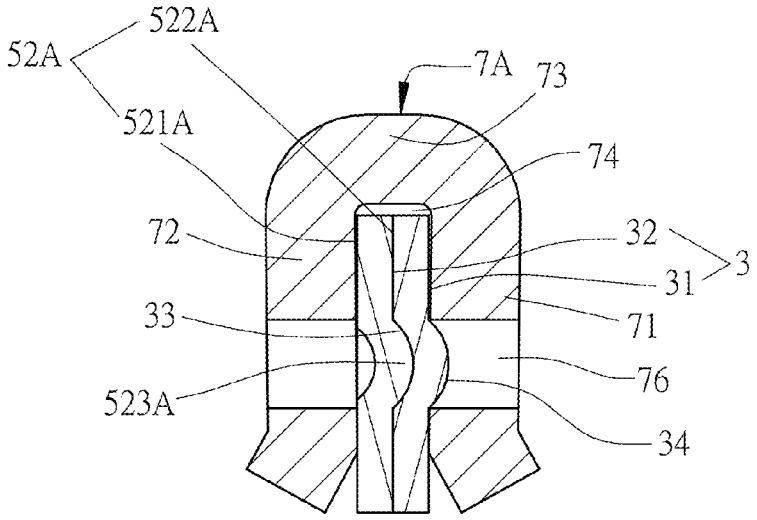
FIG. 6 is a section view of a socket having an overheating destructive limiting element in FIG. 4 according to the first embodiment of the present invention.

Referring to FIG. 5 and FIG. 6, more specifically, the limiting element 7A further includes a connection portion 73 that connects the first insulation portion 71 and the second insulation portion 72. The connection portion 73, the first insulation portion 71 and the second insulation portion 72 define a limiting space 74 and a placement entrance 75 in communication with the limiting space 74. Preferably, the placement entrance 75 defined by the first insulation portion 71 and the second insulation portion 72 of the limiting element 7A is provided with a guide portion 751, which is a slanted surface or an arched surface.

The live wire conductive plate 3 and the live wire contact portion 52A are respectively provided with fastening portions 33 and 523A that fasten with each other. For example, the fastening portions 33 and 523A are coordinating bumps or dents for fixing bonding positions of the live wire conductive plate 3 and the live wire contact portion 52A to prevent the positioned live wire conductive plate 3 and live wire contact portion 52A from again dislocated. Preferably, the live wire conductive plate 3 is provided with a first positioning portion 34, and the limiting element 7A is provided with a second positioning portion 76. The second positioning portion 76 and the first positioning portion 34 of the live wire conductive plate 3 are positioned with each other to further position the live wire conductive plate 3 and the live wire contact portion 52A with the limiting element 7A.

The live wire conductive plate 3 and the live wire contact portion 52A have respective thicknesses, which added up to total thickness A when superimposed with each other. Before the limiting element 7A presses against the live wire conductive plate 3 and the live wire contact portion 52A, between the first insulation portion 71 and the second insulation portion 72 is a distance B1. The distance B1 gradually reduces from the connection portion 73 of the limiting element 7A towards the placement entrance 75 to a distance B2 of the total thickness A, so as to further reinforce a clamping force of the limiting element 7A for securing the live wire conductive plate 3 and the live wire contact portion 52A.

Figure 8:
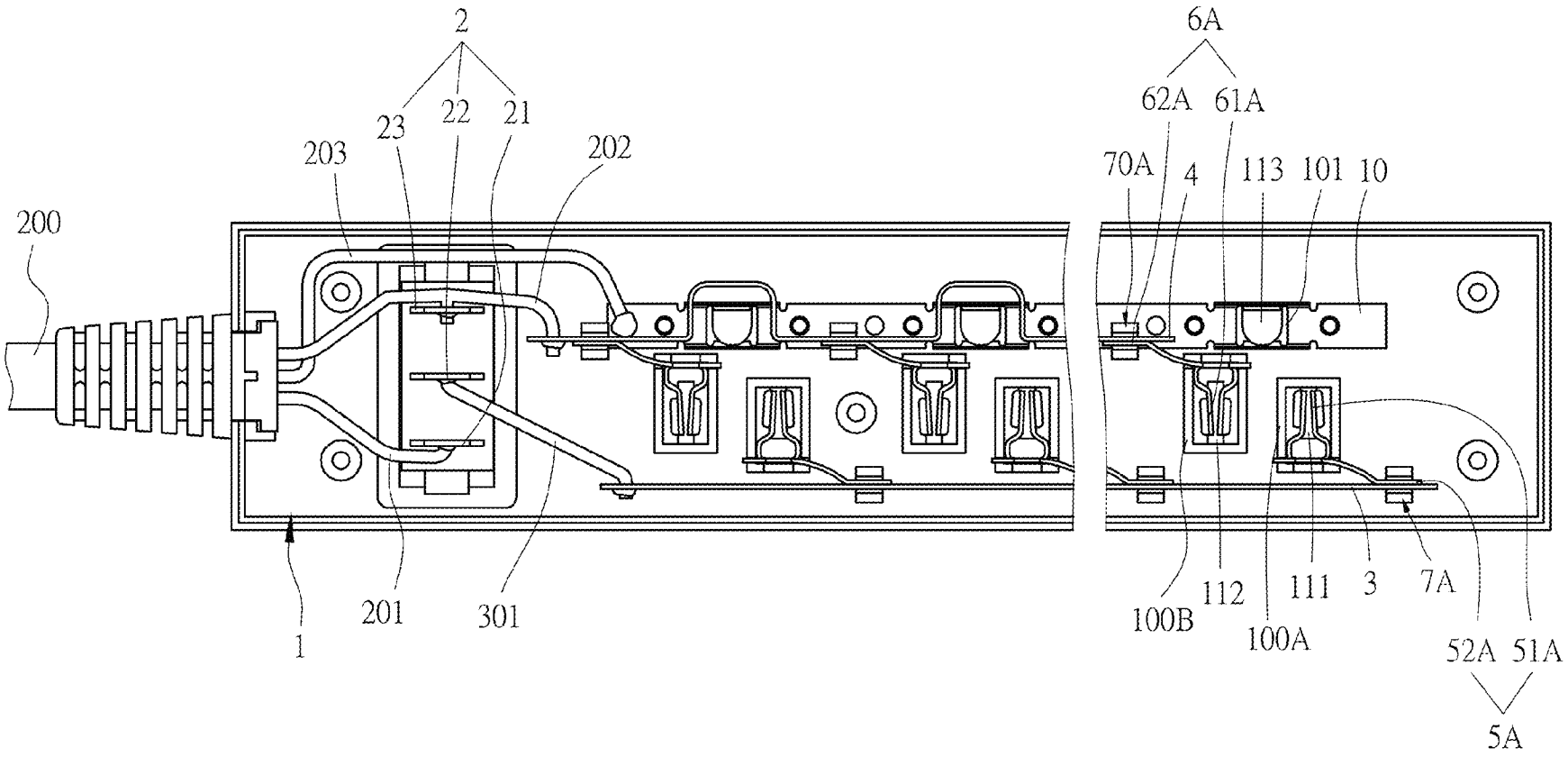
FIG. 8 is a schematic diagram of components in a housing of a socket having an overheating destructive limiting element according to the first embodiment of the present invention.

FIG. 8 shows a bottom view of the lower casing hidden in the housing of the socket. The housing 1 includes a plurality of embedding portions (one group of embedding portions 100A and 100B are given as an example for the sake of simplicity). The embedding portions 100A and 100B are respectively fastened to the live wire terminal and the neutral wire terminal (e.g., the live wire terminal 5A and the neutral wire terminal 6A), so to provide the live wire contact portion 52A with a predetermined elastic force for keeping away from the live wire conductive plate 3 as well as the neutral wire contact portion 62A with a predetermined elastic force for keeping away from the neutral wire conductive plate 4. For application, a plug connected to a load is inserted into any socket of the present invention. Being clamped by the limiting element 7A, the live wire conductive plate 3 and the live wire contact portion 52A are in thorough contact. Meanwhile, the neutral wire conductive plate 4 and the neutral wire contact portion 62A of the neutral wire terminal 6A are also in thorough contact as being clamped by the limiting element 70A. As a result, a preferred conductive effect is obtained to effectively reduce the temperature generated from the conducting current that passes through.

Figure 9:
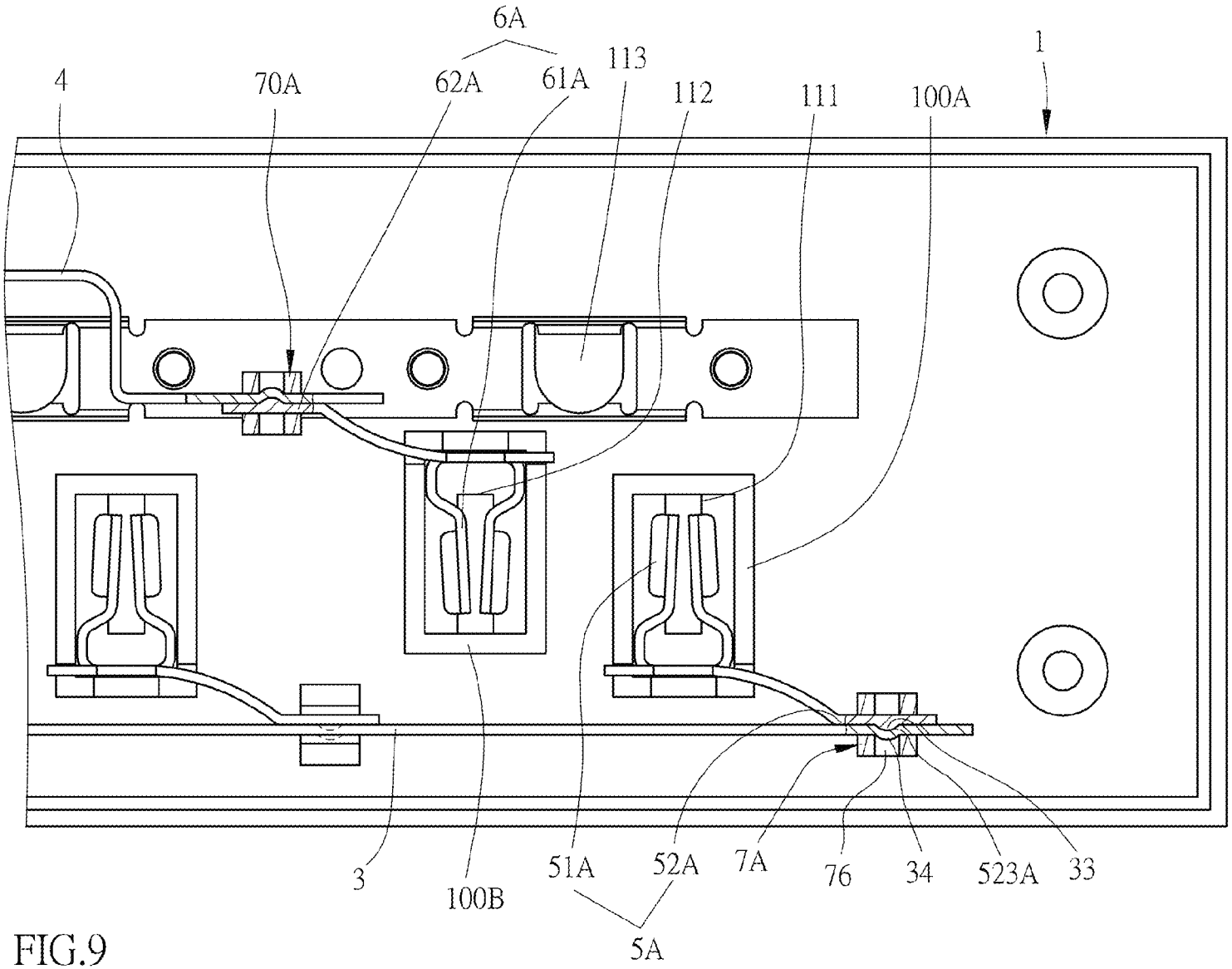
FIG. 9 is an enlarged partial section view of a socket having an overheating destructive limiting element in FIG. 8 according to the first embodiment of the present invention.

Also referring to FIG. 9, the live wire conductive plate 3 and the live wire contact portion 52A are respectively provided with the fastening portions 33 and 523A that fasten with each other, and the live wire conductive plate 3 and the limiting element 7A are respectively provided with the first positioning portion 34 and the second positioning portion 76 that are positioned with each other. Thus, the live conductive plate 3 and the live wire terminal 5A are securely positioned and are prevented from being dislocated, such that the live wire terminal 5A is allowed to precisely align with the live wire hole 111 of the housing 1 when assembled. Similarly, the fastening portion, the first positioning portion and the second positioning portion may also be provided at the contact parts of the neutral wire conductive plate 4, the neutral wire contact portion 62A and the limiting element 70A, respectively, so as to allow the neutral wire terminal 6A to precisely align with the neutral wire hole 112 of the housing 1 when assembled to enhance assembly quality of the product.

Figure 10:
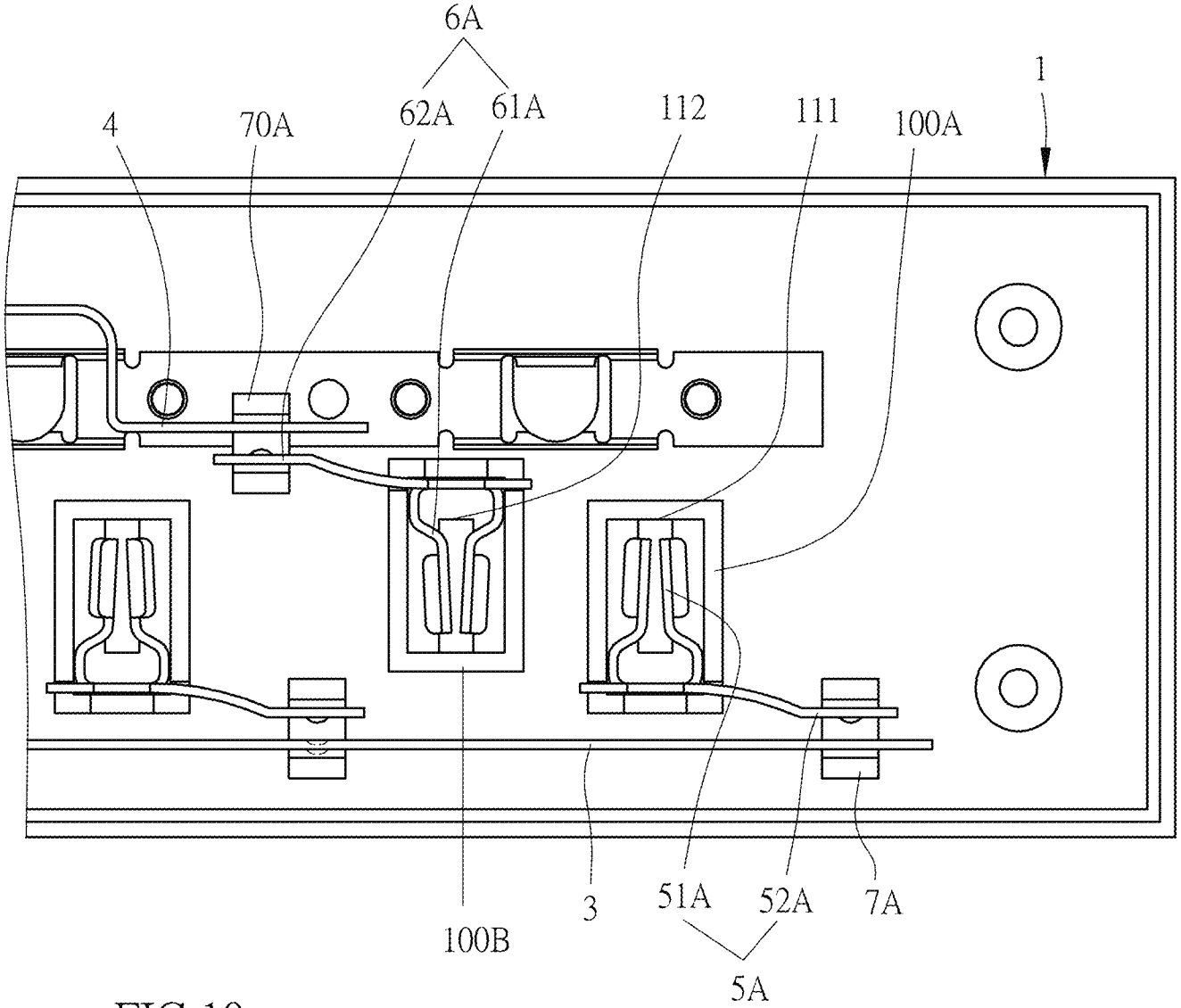
FIG. 10 is a schematic diagram of a socket having an overheating destructive limiting element when deformed and destructed according to the first embodiment of the present invention.

Referring to FIG. 10, when current overload, short circuit or circuit overheating occurs in any of the sockets to cause an operating temperature at the contact parts of the live wire conductive plate 3 and the live wire contact portion 52A or the contact parts of the neutral wire conductive plate 4 and the neutral wire contact portion 62A to reach the thermal deformation temperature (e.g., 120° C.), the limiting elements 7A and 70A may become deformed and destructed under the influence of the thermal deformation temperature. At this point, the live wire contact portion 52A is kept away from the live wire conductive plate 3 by the predetermined elastic force, or the neutral wire contact portion 62A is kept away from the neutral wire conductive plate 4 by the predetermined elastic force. Thus, the turn-on position changes to the turn-off position to disconnect the supply of the current to prevent the operating temperature from rising further. Being non-conductive materials, the limiting elements 7A and 70A become deformed and destructed or even broken into halves when heated. Thus, it is ensured that the destructed limiting elements 7A and 70A do not accidentally come into contact with surrounding electronic components and thus do not cause short circuits, thereby enhancing application safety.

Figure 11:
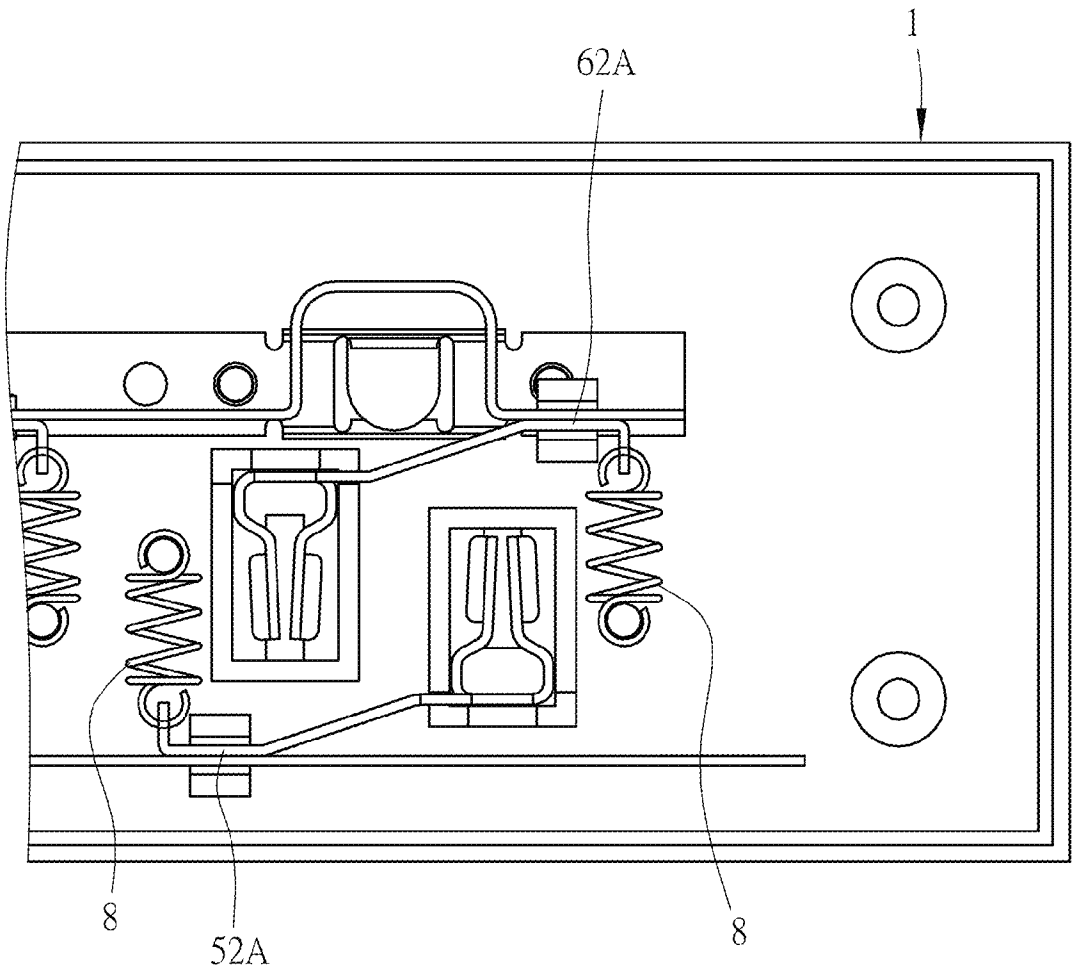
FIG. 11 is a schematic diagram of a socket having an overheating destructive limiting element according to a second embodiment of the present invention.

Referring to FIG. 11, the live wire contact portion 52A and the neutral wire contact portion 62A in the above embodiment are provided with a predetermined elastic force through a bent material. Using the predetermined elastic force, the live wire contact portion 52A and the neutral wire contact portion 62A are separated from each other when necessary to form the turn-off state. The above predetermined elastic force may be generated by various approaches. For example, a spring 8 may be connected between the live wire contact portion 52A and the housing 1 (e.g., by means of fastening holes, hooks or buckles). In a normal condition, the spring 8 is constantly stretched to provide the live wire contact portion 52A with a predetermined elastic force. Similarly, the same effect can be achieved by connecting a spring between the neutral wire contact portion 62A and the housing 1. It should be noted that, other equivalent forms capable of providing the live wire contact portion 52A and the neutral wire contact portion 62A with a predetermined elastic force are also encompassed within the scope of the present invention.

Figure 12A:
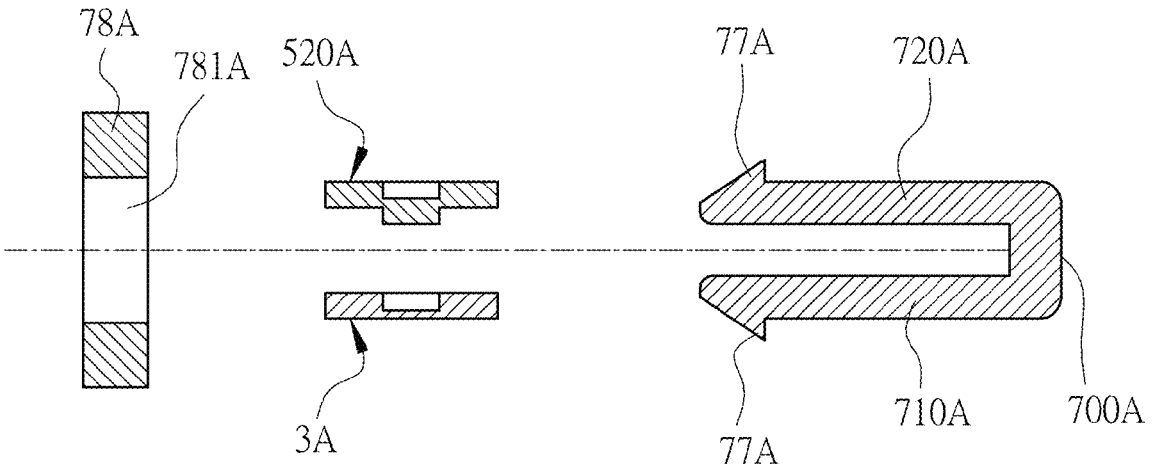
FIG. 12A is an exploded section view of a socket having an overheating destructive limiting element according to a third embodiment of the present invention.
Figure 12B:
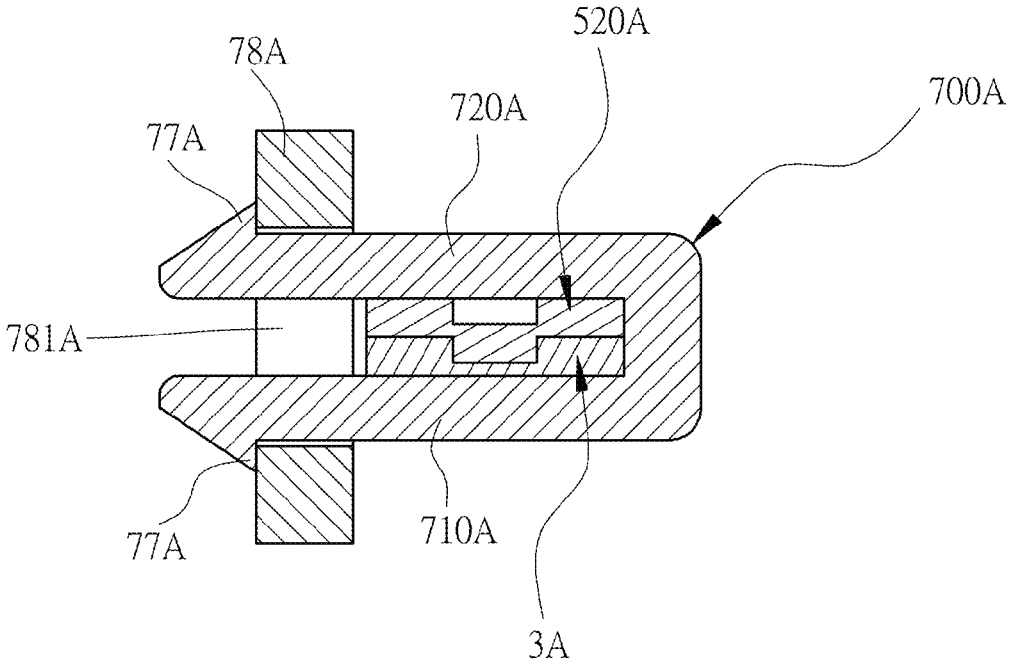
FIG. 12B is a section view of a socket having an overheating destructive limiting element according to the third embodiment of the present invention.

FIG. 12A and FIG. 12B show a third embodiment of the present invention. A main difference of the third embodiments from the foregoing embodiments is that, a limiting element 700A is provided with a joining portion 77A and a securing element 78A. The securing element 78A is at least provided with a securing opening 781A. The securing opening 781A is accommodated around a first insulation portion 710A and a second insulation portion 720A of the limiting element 700A, and is abutted against the joining portion 77A, so as to reinforce the clamping effect of the limiting element 700A on a live wire conductive plate 3A and a live wire contact portion 520A.

Figure 13A:
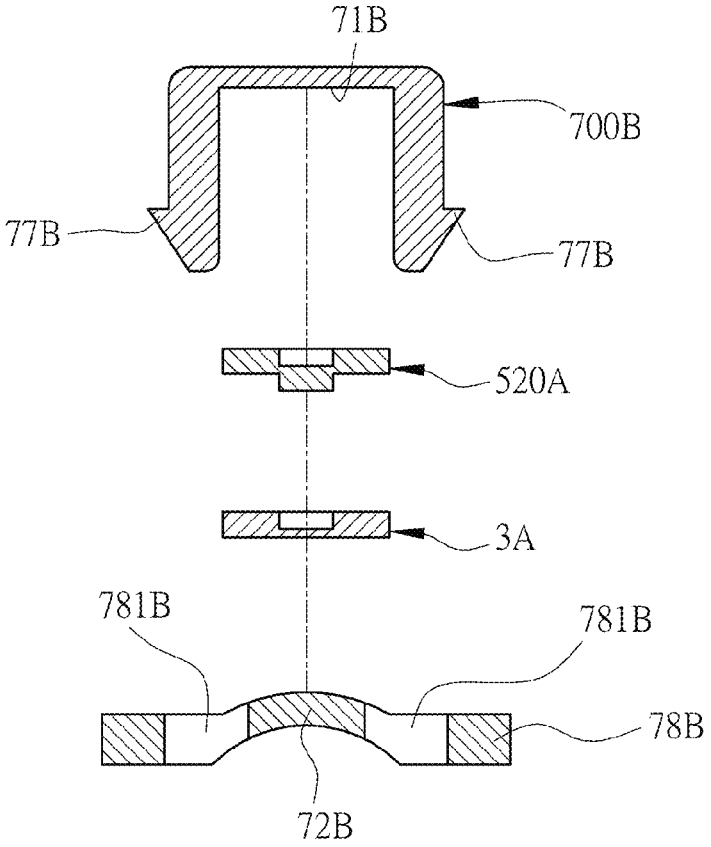
FIG. 13A is an exploded section view of a socket having an overheating destructive limiting element according to a fourth embodiment of the present invention.
Figure 13B:
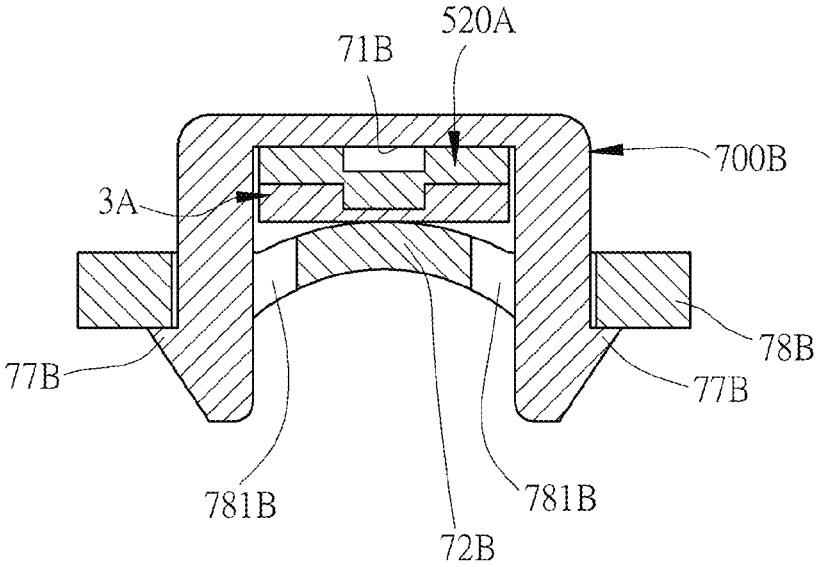
FIG. 13B is a section view of a socket having an overheating destructive limiting element according to the fourth embodiment of the present invention.

FIG. 13A and FIG. 13B show a fourth embodiment of the present invention. A main difference of the fourth embodiments from the foregoing embodiments is that, a limiting element 700B is provided with a joining portion 77B and a securing element 78B. The securing element 78B is provided with a securing opening 781B corresponding to the joining portion 77B, such that the limiting element 700B becomes combined with the securing element 78B into a ring body. A first insulation portion 71B and a second insulation portion 72B are provided at an inner surface of the ring body. Particularly, the second insulation portion 72B is located on the securing element 78B, and exhibits as a protruding surface for further packing the live wire conductive plate 3A and the live wire contact portion 520A.

Figure 14A:
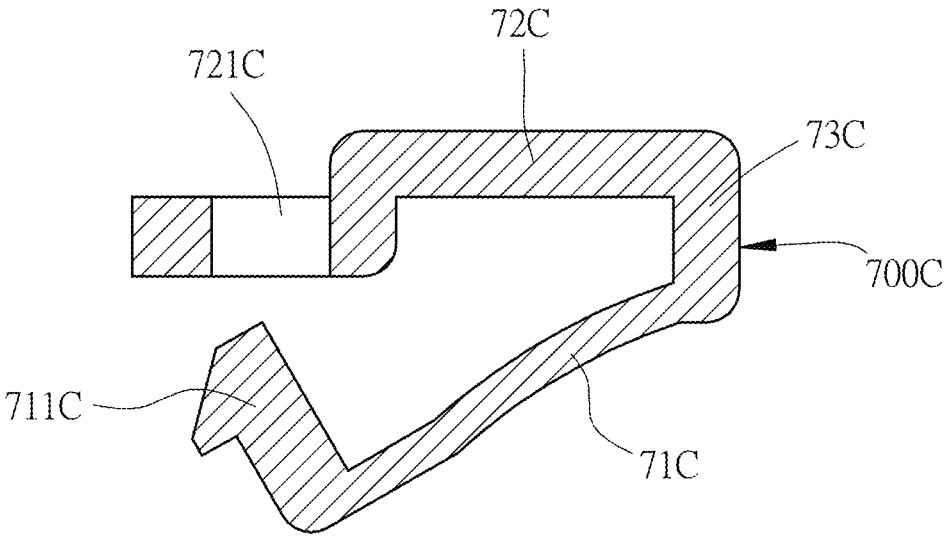
FIG. 14A is a section view of a socket having an overheating destructive limiting element according to a fifth embodiment of the present invention.
Figure 14B:
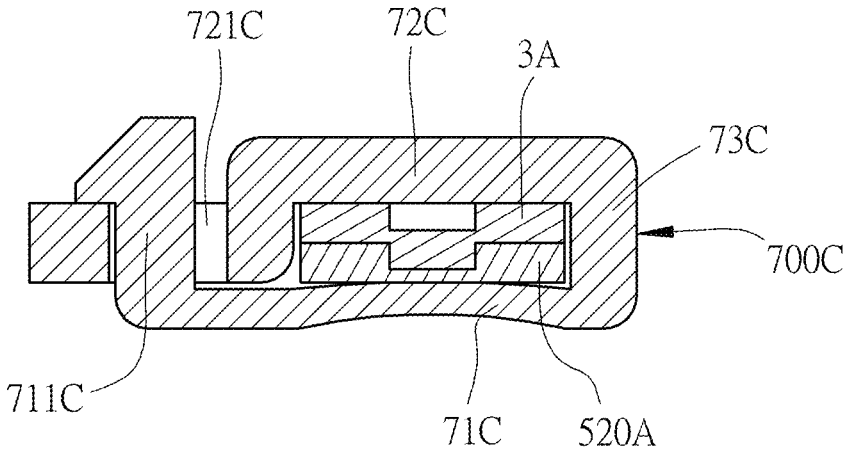
FIG. 14B is another section view of a socket having an overheating destructive limiting element according to the fifth embodiment of the present invention.

FIG. 14A and FIG. 14B show a fifth embodiment of the present invention. In a limiting element 700C according to the fifth embodiment, a first insulation portion 71C is provided with a first fastening portion 711C and a second insulation portion 72C is provided with a second fastening portion 721C. Further, a connection portion 73C connects the first insulation portion 71C and the second insulation portion 72C, so as to fasten the first fastening portion 711C of the first insulation portion 71C and the second fastening portion 721C of the second insulation portion 72C to each other by bending the connecting portion 73C, and to further clamp the live wire conductive plate 3A and the live wire contact portion 520A.

Preferably, the second fastening portion 721C is an embedding opening, and the first fastening portion 711C is an embedding pole. The embedding pole is for embedding into the embedding opening, and a diameter of the embedding pole is smaller than a diameter of the embedding opening.

Figure 15A:
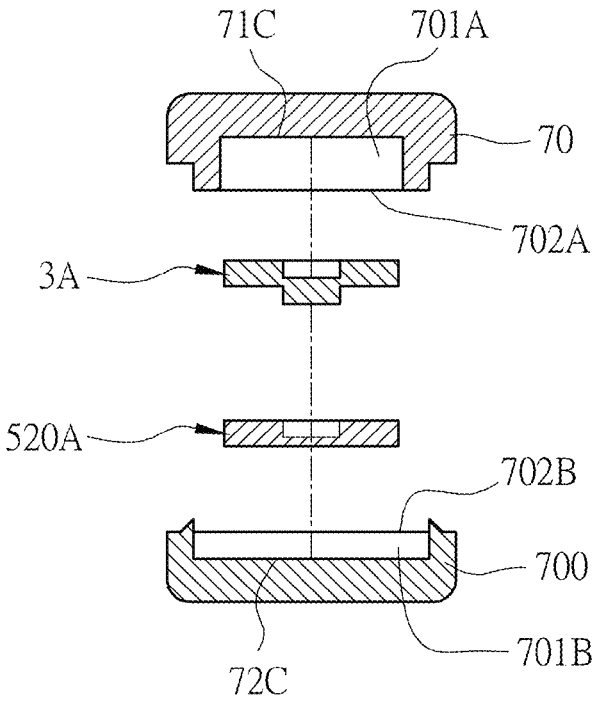
FIG. 15A is a section view of a socket having an overheating destructive limiting element according to a sixth embodiment of the present invention.
Figure 15B:
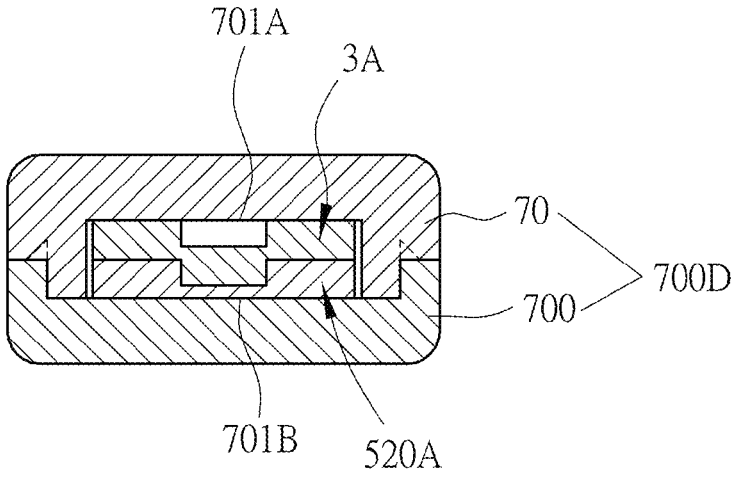
FIG. 15B is another section view of a socket having an overheating destructive limiting element according to the sixth embodiment of the present invention.

FIG. 15A and FIG. 15B show a sixth embodiment of the present invention. In the sixth embodiment, a limiting element 700D is formed by a pair of cover bodies 70 and 700 correspondingly combined to each other. For example, means for combining the cover bodies 70 and 700 may be ultrasonic welding, embedding or adhesion. The cover bodies 70 and 700 define chambers 701A and 701B, respectively, which are in communication with openings 702A and 702B of the chambers 701A and 702B, respectively. An inner side of the cover body 70 opposite the opening 702A is provided with a first insulation portion 71C, and an inner side of the other cover body 700 is correspondingly provided with the second insulation portion 72C, so as to clamp the live wire conductive plate 3A and the live wire contact portion 520A.

Figure 16:
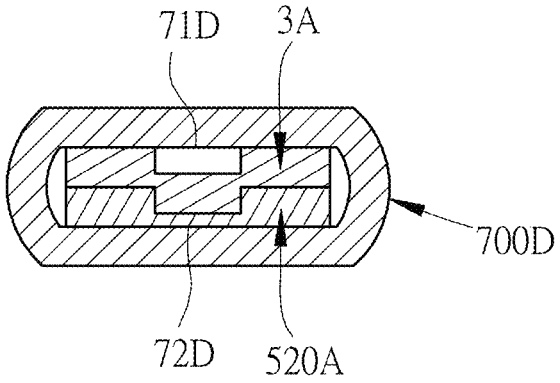
FIG. 16 is a section view of a socket having an overheating destructive limiting element according to a seventh embodiment of the present invention.

Referring to FIG. 16 also showing the seventh embodiment of the present invention, the limiting element 700D is a ring body, and the first insulation portion 71D and the second insulation portion 72D of the limiting element 700D are both located at the inner side of the ring body. As such, the live wire conductive plate 3A and the live wire contact portion 520A are also similarly clamped to form the turn-on position.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A socket having an overheating destructive limiting element, comprising:

a housing, including at least one live wire hole and at least one neutral wire hole;

a live wire conductive plate;

a neutral wire conductive plate;

at least one live wire terminal, including a live wire insertion portion and a live wire contact portion, the live wire insertion portion corresponding to the live wire hole and disposed in the housing, the live wire contact portion being in contact with the live wire conductive plate;

at least one neutral wire terminal, including a neutral wire insertion portion and a neutral wire contact portion, the neutral wire insertion portion corresponding to the neutral wire hole and disposed in the housing, the neutral wire contact portion being in contact with the neutral wire conductive plate; and at least one limiting element, being an insulating body, disposed at contact parts of the live wire conductive plate and the live wire contact portion, and/or at contact parts of the neutral wire conductive plate and the neutral wire contact portion;

wherein, the limiting element becomes deformed and destructed under a thermal deformation temperature, such that the live wire contact portion disengages from the live wire conductive plate via a predetermined elastic force, and/or the neutral wire contact portion disengages from the neutral wire conductive plate via the predetermined elastic force.

2. The socket having an overheating destructive limiting element according to claim 1, wherein the limiting element comprises a first insulation portion, a second insulation portion and a connection portion; the connection portion connects the first insulation portion and the second insulation portion; the connection portion, the first insulation portion and the second insulation portion define a limiting space and a placement entrance in communication with the limiting space.

3. The socket having an overheating destructive limiting element according to claim 2, wherein the first insulation portion and/or the second insulation portion are/is provided with a guide portion at the placement entrance; the guide portion is a slanted surface or an arched surface.

4. The socket having an overheating destructive limiting element according to claim 3, wherein between the first insulation portion and the second insulation portion of the limiting space is a distance, which gradually reduces from the connection portion towards the placement entrance.

5. The socket having an overheating destructive limiting element according to claim 1, wherein the contact parts of the live wire conductive plate and the live wire contact portion are provided with respective live wire fastening portions that position with each other, and/or the contact part of the neutral wire conductive plate and the neutral wire contact portion are provided with respective neutral wire fastening portions that position with each other.

6. The socket having an overheating destructive limiting element according to claim 5, wherein the live wire conductive plate or the live wire contact portion is provided with a first positioning portion, and the limiting element is provided with a second positioning portion; the second positioning portion is fastened and positioned with the first positioning portion.

7. The socket having an overheating destructive limiting element according to claim 2, wherein the limiting element further comprises a joining portion and a securing element; the securing element is at least provided with a securing opening, which is accommodated around the first insulation portion or the second insulation portion of the limiting element and abuts against the joining portion.

8. The socket having an overheating destructive limiting element according to claim 7, wherein the second insulation portion is located on the securing element.

9. The socket having an overheating destructive limiting element according to claim 8, wherein the second insulation portion at the securing element is a protruding surface for packing the contact parts of the live wire conductive plate and the live wire contact portion, or the contact parts of the neutral wire conductive plate or the neutral wire contact portion.

10. The socket having an overheating destructive limiting element according to claim 1, wherein the limiting element comprises two cover bodies combined with each other, and the two cover bodies define respective chambers and respective openings in communication with the respective chambers.

11. The socket having an overheating destructive limiting element according to claim 2, wherein the limiting element further comprises a first fastening portion and a second fastening portion; the first fastening portion is disposed on the first insulation portion, and the second fastening portion is disposed on the second insulation portion to correspondingly fasten with the first fastening portion.

12. The socket having an overheating destructive limiting element according to claim 11, wherein the first fastening portion is an embedding pole and the second fastening portion is an embedding opening, the embedding pole is for embedding into the embedding opening, and a diameter of the embedding pole is smaller than that of the embedding opening.

13. The socket having an overheating destructive limiting element according to claim 2, wherein the limiting element exhibits as a ring body for accommodating around the contact parts of the live wire conductive plate and the live wire contact portion, and/or the contact parts of the neutral wire conductive plate and the neutral wire contact portion; the first insulation portion and the second insulation portion are located at an inner side of the ring body.

14. The socket having an overheating destructive limiting element according to claim 1, wherein the limiting element is a plastic material selected from a group consisting of polyamide (PA) fibers, polypropylene (PP), acrylonitrile butadiene styrene copolymer (ABS resin), polymethyl methacrylate (PMMA), polycarbonate (PC), and a mixture of PC and styrene copolymer ABS resin; the thermal deformation temperature is between 100° C. and 300° C.

15. The socket having an overheating destructive limiting element according to claim 1, further comprising an elastic member, which is connected at the housing and the live wire contact portion, and/or at the housing and the neutral wire contact portion.

* * * * *